US008814061B1

(12) United States Patent
Delaney et al.

(10) Patent No.: US 8,814,061 B1
(45) Date of Patent: Aug. 26, 2014

(54) ROTARY NOZZLE CLEANING APPARATUS WITH IMPROVED STEM

(75) Inventors: Robert E. Delaney, Kennett Square, PA (US); Andrew K. Delaney, West Chester, PA (US); Bentley F. Gleeson, Plymouth Meeting, PA (US); Suneeth D. A. Molugu, Devon, PA (US)

(73) Assignee: Alfa Laval Tank Equipment, Inc., Exton, PA (US)

( * ) Notice: Subject to any disclaimer, the term of this patent is extended or adjusted under 35 U.S.C. 154(b) by 1154 days.

(21) Appl. No.: 12/459,069

(22) Filed: Jun. 26, 2009

(51) Int. Cl.
*B05B 3/04* (2006.01)
*B05B 3/00* (2006.01)

(52) U.S. Cl.
USPC ..... 239/240; 239/227; 239/243; 239/248

(58) Field of Classification Search
CPC ..... B05B 3/04; B05B 3/0409; B05B 3/0418; B05B 3/0463; B05B 3/0468; B05B 3/0422; B05B 3/0427; B05B 3/0445; B08B 9/0936
USPC ..... 239/225.1, 227, 240, 246, 243, 248, 239/DIG. 1, DIG. 13
See application file for complete search history.

(56) References Cited

U.S. PATENT DOCUMENTS

| | | | | |
|---|---|---|---|---|
| 3,637,138 | A | | 1/1972 | Rucker |
| 4,359,800 | A | * | 11/1982 | Ziels ..... 15/316.1 |
| 5,012,976 | A | | 5/1991 | Loberg |
| 5,092,523 | A | | 3/1992 | Rucker et al. |
| 5,169,069 | A | | 12/1992 | Rucker et al. |
| 5,954,271 | A | | 9/1999 | Le |
| 6,123,271 | A | | 9/2000 | Delaney et al. |
| 6,561,199 | B2 | | 5/2003 | Gleeson et al. |
| 7,523,512 | B1 | | 4/2009 | Delaney et al. |

* cited by examiner

*Primary Examiner* — Jason Boeckmann
*Assistant Examiner* — Steven M Cernoch

(57) ABSTRACT

A rotary nozzle cleaning apparatus is provided with an improved stem enabling an optimum flow of pressurized fluid while retaining structural strength. The stem is tubular in shape and formed with a series of triangular openings through the wall thereof. Alternating triangular openings are oriented with their apexes facing downstream of the fluid with interspersed openings oriented with their apexes facing upstream. The triangular openings are isosceles in configuration. The stem may be formed integral with an inlet cap of the cleaning apparatus or as a separate component.

16 Claims, 5 Drawing Sheets

ROTARY NOZZLE CLEANING APPARATUS WITH IMPROVED STEM

FIELD OF THE INVENTION

The present invention relates to the field of apparatus for cleaning vessels, such as tanks and barrels, using a pressurized cleaning fluid discharged from a rotating nozzle.

BACKGROUND OF THE INVENTION

Numerous designs for rotary fluid stream apparatuses have been developed and used. Variations in features from one design to another relate to the vessel to be cleaned or provide an improvement over prior art. Certain of the cleaning apparatus designs are disclosed in U.S. Pat. No. 3,637,138 to Rucker, U.S. Pat. No. 5,012,976 to Loberg, U.S. Pat. No. 5,092,523 to Rucker et al., U.S. Pat. No. 5,169,069 to Rucker et al., U.S. Pat. No. 5,954,271 to Le, U.S. Pat. No. 6,123,271 to Delaney et al., U.S. Pat. No. 6,561,199 to Gleeson et al. and U.S. Pat. No. 7,523,512 to Delaney et al.

The common operational theme in the cleaning apparatus disclosed in these patents and other cleaning apparatus known in the trade is that a pressurized fluid drives a gear train to cause a set of nozzles to rotate, and the fluid flows through a housing to be discharged from the rotating nozzles. The nozzles typically are driven by a gear train to rotate around two orthogonal axes simultaneously. As depicted in the above noted patents, rotary nozzle cleaning devices can be designed either with the gear train between the fluid inlet cap and the nozzle housing or with the nozzle housing between the fluid inlet cap and the gear train. The fluid must therefore be conveyed from a path in the core of the mechanism to the periphery of the mechanism in order to be discharged through the rotating nozzles. This core to periphery conveyance is enabled by a tubular component known as a stem. A circumferential series of perforations are formed through the stem wall. Details of a particular stem are disclosed in U.S. Pat. No. 5,012,976, incorporated herein by reference (the '976 patent). The stem configuration in the '976 patent is characterized as having "Z" shaped openings through the tubular wall with "Z" shaped separating bars between adjacent pairs of openings. The '976 patent teaches providing an equal amount of opening exposed to the nozzle housing throughout a 360° rotation cycle, therefore enabling a uniform fluid flow to the nozzles. While uniform fluid flow is clearly beneficial, it has been determined that the "Z" shaped separating bars are structurally inadequate. The "Z" shaped bars have been found to be prone to distortion or fracture if the stem is subjected to excess torque when being installed or if the stem is dropped on a hard surface. In a later development, a stem having multiple rows of small round openings has been used, as disclosed in U.S. Pat. No. 6,123,271. While this design reasonably overcomes the structural strength problem, the flow rate is sacrificed. Therefore, a need exists for a structurally solid stem for a rotary nozzle cleaning apparatus that allows a uniform and optimum fluid flow therethrough.

SUMMARY OF THE INVENTION

The present invention rotary nozzle cleaning apparatus with improved stem overcomes the above noted drawbacks of the prior art. The improved stem has triangular openings through the tubular stem wall with rounded corners. The openings alternate in orientation with a first triangle pointing upstream and a second triangle pointing downstream. The openings are separated by a series of linear bars at mirror image angles. In a first embodiment of the invention, the stem is an integral portion of a fluid inlet cap, and in a second embodiment, the stem is formed as a separate component that is installed in the cleaning apparatus. A set of nozzles is rotationally mounted on a T-housing that is rotated around the longitudinal axis of the cleaning apparatus by a fluid under pressure driving a gear train. As the T-housing rotates, different triangular stem openings are exposed to a T-housing passage. Each of the triangular stem openings in turn, or a combination of two adjacent partial openings, provides an equal flow area for the fluid to pass through the outlet channel to a nozzle housing.

BRIEF DESCRIPTION OF THE DRAWINGS

The present invention is best understood in conjunction with the accompanying drawing figures in which like elements are identified by similar reference numerals and wherein.

DETAILED DESCRIPTION OF THE PREFERRED EMBODIMENTS

Figure 1:
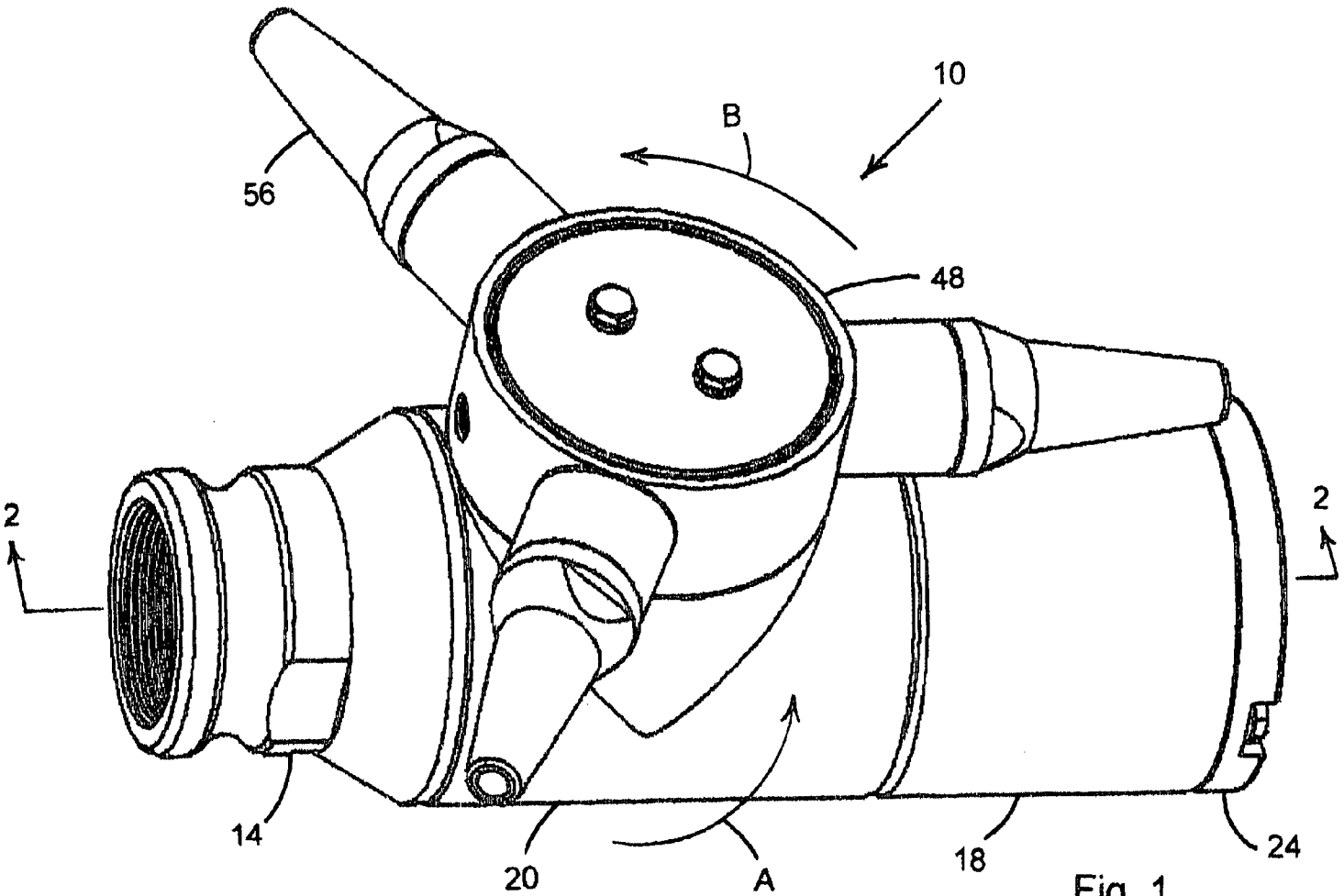
FIG. 1 is a perspective view of a first preferred embodiment rotary nozzle cleaning apparatus of the present invention.

Referring to FIG. 1, a first embodiment rotary nozzle cleaning apparatus 10 is shown in perspective view. An inlet cap 14, configured for connecting to a source of a pressurized fluid, e.g. a pressurized cleaning fluid, is assembled to a first end of a hollow T-housing 20. T-housing 20 is connected at a second end to a hollow body 18. A base cover 24 is affixed to the distal end of body 18 as a seal. In operation of cleaning apparatus 10, inlet cap 14 and hollow body 18 remain substantially fixed and do not rotate. T-housing 20 is able to rotate relative to inlet cap 14 and relative to hollow body 18 in the direction indicated by arrow A. A nozzle housing 48 is assembled to T-housing 20 in a manner allowing nozzle housing 48 to rotate in the direction indicated by arrow B. Arrow B defines a plane that is substantially perpendicular to the plane defined by arrow A. A number of nozzles 56 are assembled to nozzle housing 48 to discharge a set of spherically rotating streams of pressurized fluid as T-housing 20 and nozzle housing 48 rotate in perpendicular planes. Whereas the present invention is illustrated having 3 nozzles 56, it is understood that different numbers of nozzles, e.g. 2 or 4 nozzles, may be utilized.

Figure 2:
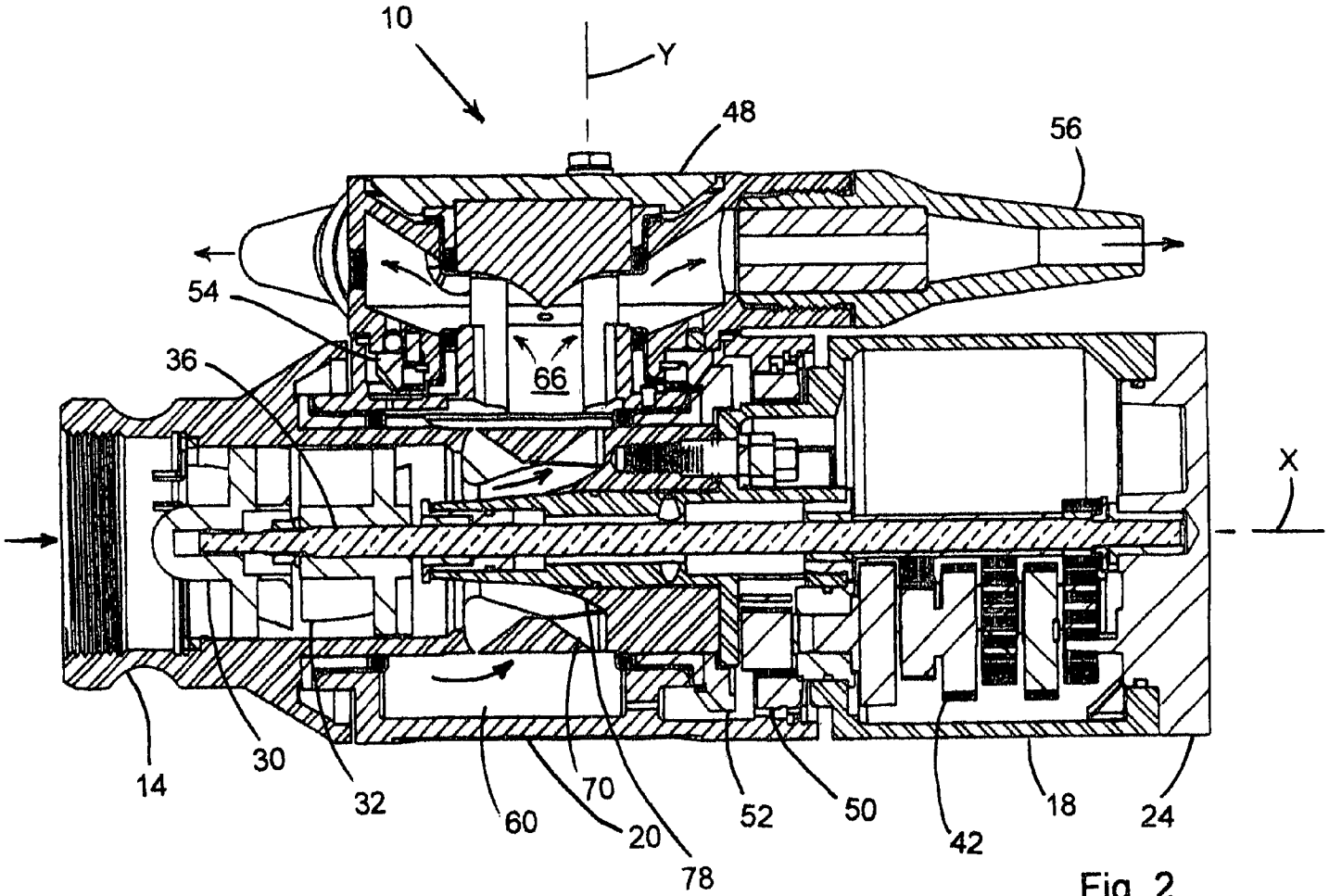
FIG. 2 is a cross sectional view of the apparatus taken in the direction indicated by line 2-2 of FIG. 1.

Referring now to FIG. 2, a cross sectional view is illustrated as taken in the direction of line 2-2 of FIG. 1. The path of pressurized fluid through rotating nozzle cleaning apparatus 10 of the present invention is traced by a series of arrows from inlet cap 14 to be discharged from nozzles 56. The fluid is supplied by a pressurized source (not shown) and enters through inlet cap 14. A stator 30, formed with a series of vanes oriented at an angle to axis X, is fixedly mounted in the path of the fluid to cause the pressurized fluid to swirl. A rotor 32 is mounted downstream of stator 30, rotor 32 being rotationally driven by the fluid. A drive shaft 36 is affixed to rotor 32 to rotate synchronously therewith, the downstream end of drive shaft 36 being connected to a gear train 42 that is contained within stationery body housing 18. Base cover 24 supports the distal end of drive shaft 36 and seals the space within body housing 18. Gear train 42 drives a ring gear 50 that is mounted to and rotationally drives T-housing 20 to rotate around axis X. As T-housing 20 rotates, a bevel gear 52 that is fixedly mounted within T-housing 20 drives nozzle housing bevel gear 54, thereby causing nozzle housing 48 to rotate around axis Y. Nozzles 56 rotate around second axis Y as they are moved with T-housing 20 around first axis X. Axis X and axis Y are mutually perpendicular in the preferred embodiment.

Continuing with reference to FIG. 2, it is noted that the invention employs a stem portion 70 that is formed integral with inlet cap 14. A portion of the cleaning fluid entering inlet cap 14 flows through stem portion 70 and passes through T-housing passage 66 as shown by the arrows. An internal deflector 78 is formed within stem 70 to facilitate the flow of fluid changing from inlet cap 14 in a direction that is substantially parallel to axis X to exit through T-housing passage 66 in a direction substantially parallel to axis Y. A further portion of the cleaning fluid entering inlet cap 14 flows into an annular passage 60 to also exit through T-housing passage 66 and be ultimately discharged through nozzles 56. Stem portion 70 is formed with a series of circumferentially spaced triangular openings around the periphery thereof as described more fully below. A typical, but not exclusive, configuration for the triangular openings of stem 70 is depicted in FIGS. 3-6 and described below.

Figure 3:
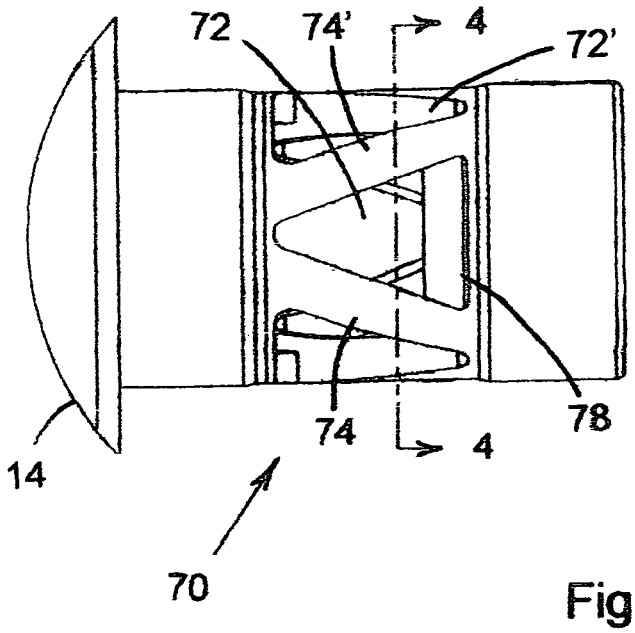
FIG. 3 is a side elevation view of an improved stem of the present invention.

Referring now to FIG. 3, stem 70 is shown in side elevation view. Stem 70 is in the form of a tubular extension of inlet cap 14 with a series of openings 72, 72' formed around the periphery thereof. Openings 72, 72' are triangular in shape. Openings 72, 72' are preferably isosceles triangles to distribute axial and torsional forces symmetrically, therefore minimizing or eliminating strain. Each of windows 72 are oriented with their apexes in the upstream direction (facing left as illustrated) and are interspersed with a plurality of windows 72' that are oriented with their apexes in the downstream direction (facing right as illustrated). The size, angle and number of triangles are dependent on the design parameters of apparatus 10 (see FIG. 2). A series of bars 74, 74' separate adjacent openings 72, 72'. Bars 74, 74' are substantially uniform in cross section throughout their respective lengths. Internal deflector 78 is formed within the downstream end of stem 70 to allow the flow of fluid to be redirected from horizontal to vertical (as illustrated) with a minimal loss of pressure, to exit through T-housing passage 66 (see FIG. 2) to ultimately be discharged through nozzles 56. According to the preferred embodiment, internal deflector 78 is substantially conical in configuration.

Figure 4:
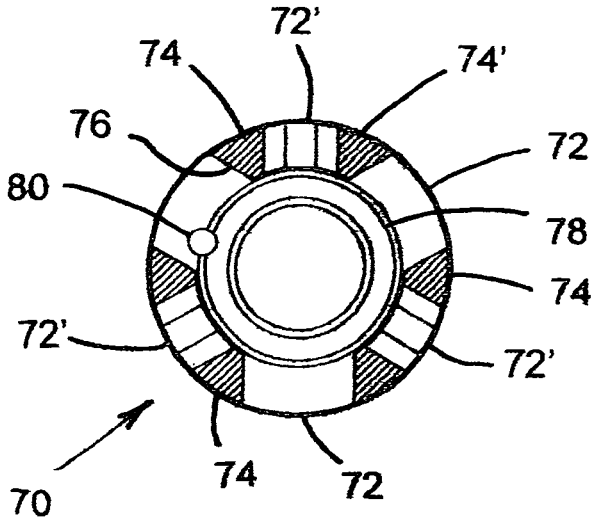
FIG. 4 is a cross sectional view of the stem taken in the direction indicated by line 4-4 of FIG. 3.

Referring now to FIG. 4, stem 70 is seen in cross section as taken in the direction indicated by line 4-4 of FIG. 3. The alternation of openings 72, 72' interspersed by bars 74, 74' in a circular pattern is clearly shown. In order to maximize fluid flow, the lateral surfaces 76 of each pair of opposed bars 74, 74' are oriented substantially parallel to one another, rather than radially, providing openings 72' of uniform area throughout. The lateral surfaces of bars 74, 74' bordering openings 72 are similarly oriented parallel to one another. In some versions of the invention, an orifice 80 passes through the base portion of stem 70 to convey a portion of the fluid into body housing 18 (see FIG. 2) to provide lubrication to gear train 42.

Figure 5A:
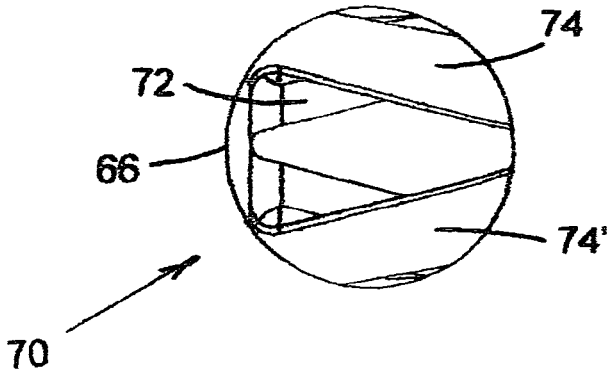
FIGS. 5A and 5B are depictions showing openings through the stem tubular wall in different rotational positions as seen through the T-housing passage.
Figure 5B:
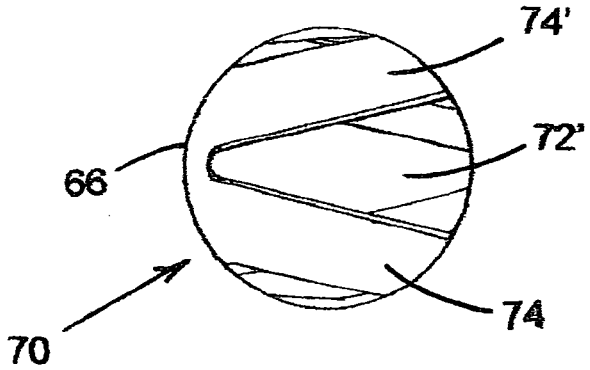

Referring now to FIGS. 5A and 5B, two views of stem 70 are shown through T-housing passage 66 (also see FIG. 2) as T-housing 20 rotates. FIG. 5A shows window 72, with the apex thereof facing downstream, visible in the center of T-housing passage 66. FIG. 5B shows window 72', with the apex thereof facing upstream, in the center of T-housing passage 66. In both positions, a substantially equal area of openings 72, 72' is presented for the passage of pressurized fluid from stem 70 to nozzle housing 48 (see FIG. 2). In an intermediate position (not shown) with a portion of opening 72 and a portion of opening 72' in the sight opening of T-housing passage 66, the total opening area is substantially similar.

Figure 6:
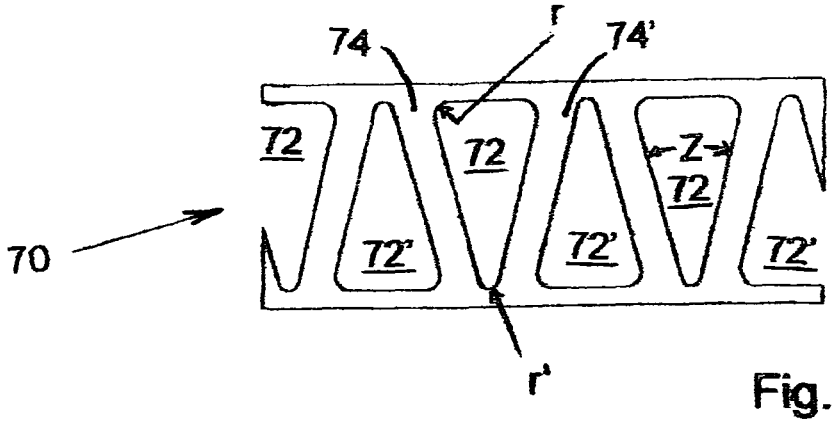
FIG. 6 is a flat layout view of the stem openings of the present invention.

Referring now to FIG. 6, stem 70 is illustrated in flat layout view showing three openings 72 and three openings 72'. A series of bars 74 and 74' separate each of adjacent openings 72, 72'. It is particularly noted that stem 70 is formed of a series of alternately inverted triangles, providing a rigid structure that is resistant to compression or torsion. In the preferred embodiment, angle Z between adjacent bars 74, 74' is in the range of 25° to 45°, and most preferably about 40°. As will be understood by those skilled in the art, angle Z and the resultant size of each opening 72, 72' is based on the diameter and length of stem 70. The intersection between bar 74 and the horizontal base of opening 72 is rounded at a radius r. The apex between adjacent bars 74, 74' is rounded at a radius r'. Radius r and radius r' are preferably in the range of 0.062 inch to 0.125 inch. This degree of rounding minimizes the chance of stress cracking at the corners while substantially maintaining the maximum size of the opening available for fluid flow.

Figure 7:
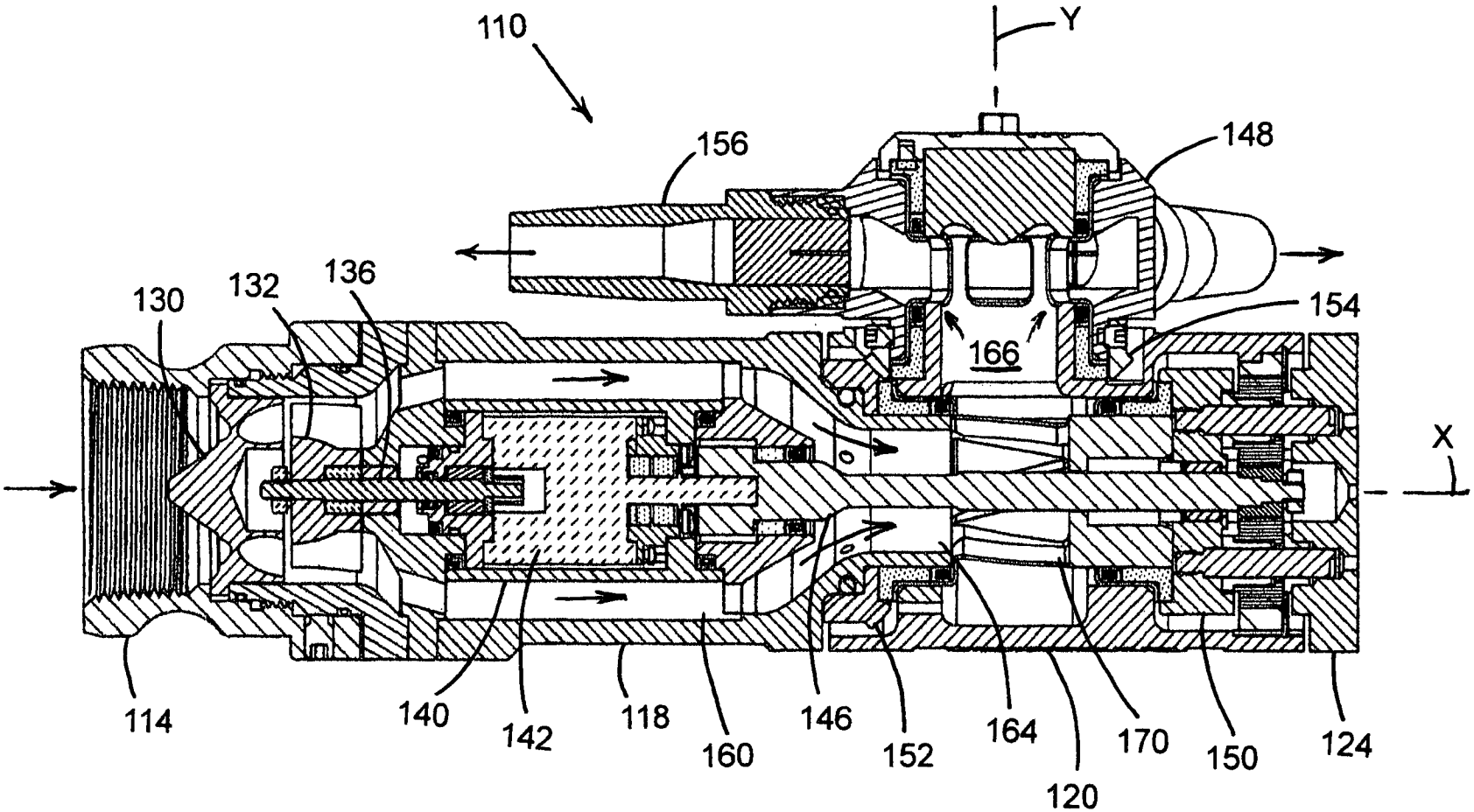
FIG. 7 is a cross sectional view of a second embodiment rotary nozzle cleaning apparatus.

Referring now to FIG. 7, a second embodiment rotary nozzle cleaning apparatus 110 is shown in cross sectional view. It is noted that a significant feature of the design concept of cleaning apparatus 10 depicted in FIGS. 1 and 2 is that T-housing 20 is positioned between inlet cap 14 and gear train 42. In contrast, cleaning apparatus 110 depicted in FIG. 7 has gear train 142 positioned between inlet cap 114 and T-housing 120.

Referring further to FIG. 7, the cleaning fluid flows through cleaning apparatus 110 along a path defined by a series of arrows. Cleaning fluid enters through inlet cap 114 and is discharged from multiple nozzles 156. The cleaning fluid is supplied by a pressurized source (not shown). The fluid passes through inlet cap 114 and a stator 130 that is formed with a series of vanes oriented at an angle to axis X to cause the pressurized fluid to swirl. A rotor 132, having oppositely oriented vanes, is positioned downstream of stator 130 and rotated by the pressurized fluid. A drive shaft 136 is affixed to rotor 132 to rotate therewith. The distal end of driveshaft 136 is connected to drive a gear train 142. Gear train 142 is contained within a gear housing 140. Gear train 142 is preferably a planetary gear train with a ratio determined according to the service use intended for rotary nozzle cleaning apparatus 110. An output drive shaft 146 passes through a tubular stem 170 to convey power from gear train 142 to a ring gear 150 that is assembled to T-housing 120, causing T-housing 120 to rotate. Whereas stem 170 is relatively distant from inlet cap 114, stem 170 is provided as a separate component. Additional design features of stem 170, particularly including triangular openings separated by bars having parallel lateral surfaces, are generally similar to that described above in relation to the stem portion of the first preferred embodiment. As T-housing 120 rotates, a fixed bevel gear 152 causes a nozzle housing bevel gear 154 to rotate, thereby rotating nozzle housing 148 with nozzles 156 assembled thereto. Appropriate support bearings and fluid seals are provided.

As shown, an annular passage 160 is formed between body 118 and gear housing 140. The pressurized fluid passing through stator 130 and rotor 132, having provided rotational power for gear train 142, then passes through annular passage 160 around gear housing 140 and output shaft 146. The fluid passes through flow passage 164 and enters tubular stem 170. The fluid then exits stem 170 in a radial direction and enters T-housing passage 166, to be discharged through rotating nozzles 156.

While the description above discloses preferred embodiments of the present invention, it is contemplated that numerous variations and modifications of the invention are possible and are considered to be within the scope of the claims that follow.

What is claimed is:

1. A rotary nozzle cleaning apparatus, comprising:

a. a hollow inlet cap for receiving a fluid;

b. a rotor positioned downstream of the inlet cap and driven rotationally by the fluid;

c. a gear train in connection with and driven by the rotor;

d. a first housing in fluid communication with the inlet cap and driven by the gear train to rotate around a first axis;

e. a second housing in fluid communication with and driven by the first housing to rotate around a second axis;

f. a plurality of nozzles mounted to the second housing and in fluid communication therewith; and g. a substantially tubular stem in fluid communication with the inlet cap and positioned within the first housing;

h. wherein a series of circumferentially spaced, triangular openings are formed through a tubular wall of the stem for conveying the fluid to the second housing.

2. The rotary nozzle cleaning apparatus described in claim 1, wherein the triangular openings are separated from one another by angularly disposed bars.

3. The rotary nozzle cleaning apparatus described in claim 2, wherein as seen in cross sectional view lateral surfaces of adjacent bars are oriented substantially parallel to one another.

4. The rotary nozzle cleaning apparatus described in claim 1, wherein interior corners of the triangular openings are each formed with a radius.

5. The rotary nozzle cleaning apparatus described in claim 1, wherein the triangular openings are formed with an angle of between approximately 25° and 45°.

6. The rotary nozzle cleaning apparatus described in claim 1, wherein the stem is formed integral with the inlet cap.

7. The rotary nozzle cleaning apparatus described in claim 6, wherein the stem is further formed with an internal deflector for facilitating the flow of the fluid from a first direction to a second direction.

8. The rotary nozzle cleaning apparatus described in claim 1, wherein the openings are shaped as isosceles triangles.

9. In a rotary nozzle cleaning apparatus, a substantially tubular stem comprising a plurality of substantially linear bars defining a series of triangular openings, alternating openings being inverted with respect to adjacent openings.

10. The stem described in claim 9, wherein the openings are shaped as isosceles triangles.

11. The stem described in claim 9, wherein as seen in cross sectional view, side edges of adjacent bars are oriented substantially parallel to one another.

12. The stem described in claim 9, wherein interior corners of the triangular openings are each formed with a radius.

13. The stem described in claim 9, wherein the triangular openings are formed with an angle of between approximately 25° and 45°.

14. The rotary nozzle cleaning apparatus described in claim 9, wherein the stem is further formed with an internal deflector for facilitating the flow of the fluid from a first direction to a second direction.

15. In a rotary nozzle cleaning apparatus, a stem comprising a substantially tubular wall having a plurality of openings formed therethrough in the shape of isosceles triangles with alternating triangular openings being inverted with respect to adjacent openings.

16. The rotary nozzle cleaning apparatus described in claim 1, wherein alternating triangular openings are inverted with respect to adjacent openings.

* * * * *